US006358162B1

(12) United States Patent
Piotrowski et al.

(10) Patent No.: US 6,358,162 B1
(45) Date of Patent: Mar. 19, 2002

(54) GOLF PUTTER WITH GREEN-READING FEATURES

(76) Inventors: John Piotrowski, 17 Trellis Way, Robbinsville, NJ (US) 08691; David M. Bitko; Sheldon S. Bitko, both of 16 Valley Forge Dr., East Brunswick, NJ (US) 08816

( * ) Notice: Subject to any disclaimer, the term of this patent is extended or adjusted under 35 U.S.C. 154(b) by 0 days.

(21) Appl. No.: 09/503,348

(22) Filed: Feb. 14, 2000

(51) Int. Cl.[7] ..... A63B 53/04
(52) U.S. Cl. ..... 473/404; 473/340
(58) Field of Search ..... 473/409, 404, 473/292, 293, 294, 313, 314, 340, 341

(56) References Cited

U.S. PATENT DOCUMENTS

| | | | | | |
|---|---|---|---|---|---|
| 2,820,638 | A | * | 1/1958 | Morrison | 473/313 |
| 3,595,577 | A | * | 7/1971 | Hodge | 473/314 |
| 4,317,568 | A | * | 3/1982 | Green | 473/238 |
| 4,527,799 | A | * | 7/1985 | Solheim | 473/341 |
| 4,605,228 | A | * | 8/1986 | Guendling, Jr. | 473/409 |
| 5,078,398 | A | | 1/1992 | Reed et al. | |
| 5,125,657 | A | * | 6/1992 | Beil | 473/293 |
| 6,224,494 | B1 | * | 5/2001 | Patsky | 473/409 |

OTHER PUBLICATIONS

Goodner, Ross, "Can Plumb Bobbing Help You?", Golf Digest, Sep. 1978, pp. 44–49.*

* cited by examiner

*Primary Examiner*—Steven Wong
(74) *Attorney, Agent, or Firm*—Burns, Doane, Swecker & Mathis, LLP

(57) ABSTRACT

A golf putter provides a horizontal reference line when the putter is freely suspended by its shaft. A longitudinal axis of the shaft passes through a center of gravity of the putting head so that the shaft, when suspended, extends vertically. The putting head forms a line which extends perpendicularly to the shaft, and thus forms a reference line which extends horizontally when the putter is suspended. The horizontal reference line can be compared to the direction of a portion of a golf green to aid in reading a slope of the green. During a putting stroke the putting head is better balanced and less susceptible to turning motions.

6 Claims, 5 Drawing Sheets

GOLF PUTTER WITH GREEN-READING FEATURES

BACKGROUND OF THE INVENTION

The present invention relates to a golf putter, and to a method of using a golf putter as an aid for reading the slopes of a putting green.

It is necessary in the game of golf for golfers to attempt to "read" the slopes of a green in order to predict the path of travel of a putted golf ball. When reading a green, golfers attempt to identify various vertical or horizontal reference lines, e.g., the flag stick, trees, parts of nearby structures., and then compare the green with the reference lines. This is a very imprecise method due to a lack of assurance that the reference line is exactly vertical or horizontal. Some golfers attempt to practice the so-called "plumb bobbing" technique wherein they freely suspend a putter and use the hanging shaft as a vertical reference line. However, not all shafts are designed to hang perfectly vertically when suspended and, regardless, it is difficult to accurately utilize a plumb bobbing technique because it requires that the golfer imagine how many degrees the green is inclined from a perpendicular relationship with the shaft, a task not easily accomplished with the naked eye, especially if the green is so inclined by only a few degrees.

It is an object of the invention to enable a putter to be more effectively used as an aid for reading a green.

SUMMARY OF THE INVENTION

This object is achieved by a golf putter which comprises a shaft and a putting head mounted at a lower end of the shaft. A lower portion of the putter includes means defining a reference line which extends horizontally when the putter is freely suspended by the shaft.

Preferably, the shaft defines a longitudinal axis which passes through a center of gravity of the putting head, and the reference line extends perpendicular to that axis.

The horizontal reference line can be formed on the putting head, or on a portion of the shaft which interconnects a main portion of the shaft with the putting head.

Another aspect of the invention involves a golf putter which comprises a shaft and a putting head mounted at a lower end of the shaft. A longitudinal axis of the shaft is aligned with a center of gravity of the putting head at least when the putter is viewed from the front. Preferably, the axis passes directly through the center of gravity of the putting head.

Another aspect of the invention involves a method of reading a slope of a putting green which comprises the steps of:

A. freely suspending a shaft such that a reference line carried by a lower portion of the shaft is oriented horizontally; and B. comparing the horizontal reference line to a portion of the putting green.

BRIEF DESCRIPTION OF THE DRAWING

The objects and advantages of the invention will become apparent from the following detailed description of preferred embodiments thereof in connection with the accompanying drawings in which like numerals designate like elements and in which.

DETAILED DESCRIPTION OF PREFERRED EMBODIMENTS OF THE INVENTION

Figure 1:
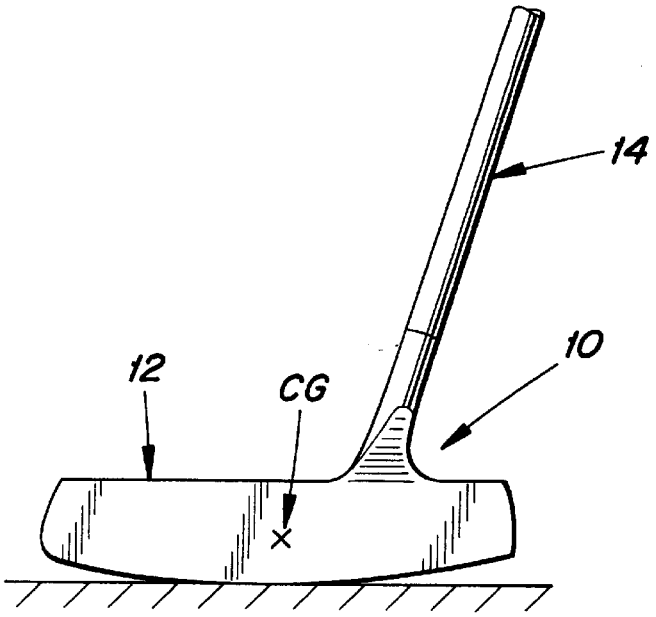
FIG. 1 (PRIOR ART)
FIG. 1 is a front elevational view of a prior art golf putter in a putting condition.
Figure 1A:
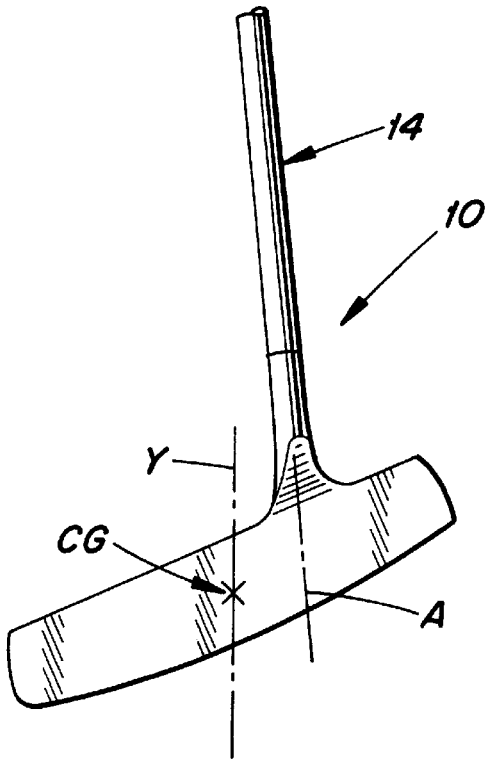
FIG. 1A (PRIOR ART)
FIG. 1A is a view similar to FIG. 1 with the putter hanging in a freely suspended state.

Depicted in FIGS. 1 and 1A is a conventional golf putter 10. The putter is depicted in a putting position in FIG. 1 and in a freely suspended position in FIG. 1A. The putter 10 includes a putting head 12 and a shaft 14 connected thereto. A center of gravity CG of the putting head 12 is offset relative to an axis A of the shaft 14.

Figure 2:
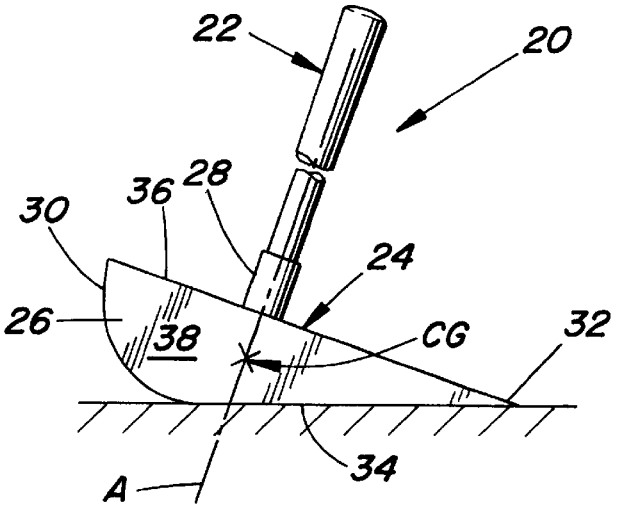
FIG. 2 is a front elevational view of a first embodiment of a putter according to the present invention, in a putting position.
Figure 2A:
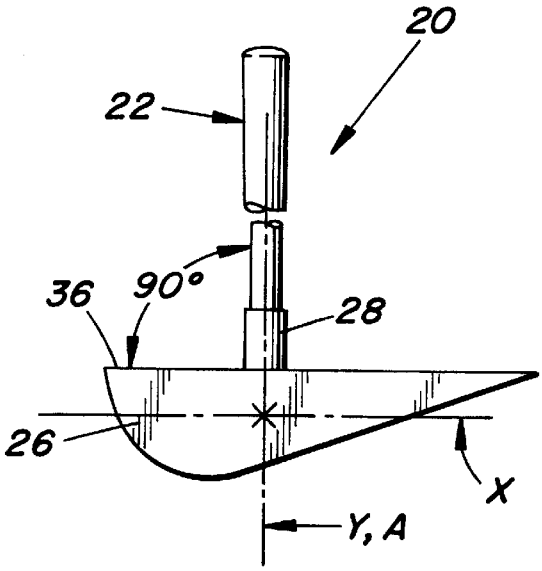
FIG. 2A is a side elevational view of the putter of FIG. 2 hanging in a freely suspended state.
Figure 2B:
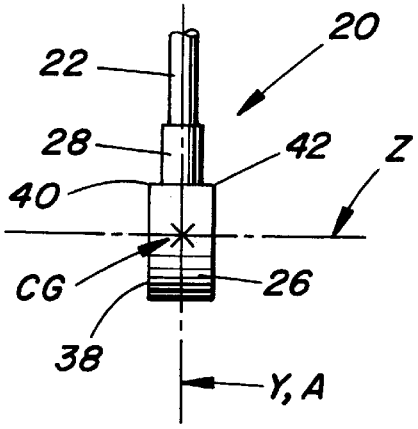
FIG. 2B is a side elevational view of the putter depicted in FIG. 2.

Depicted in FIGS. 2, 2A and 2B is a putter 20 according to a first embodiment of the invention. The putter includes a shaft 22 a blade 26, and an optional hosel 28. The blade includes a toe 30, a heel 32, a sole 34, an upper surface 36, and a front face 38. The head is continuously curved from a toe end of the surface 36 to a toe end of the sole 34 as shown in FIG. 2. The upper surface 36 and the sole 34 diverge from one another in a direction toward the toe (i.e., towards the left in FIG. 2). The axis A of the shaft 22 extends through a center of gravity CG of a head 24 of the putter, the head being configured asymmetrically relative to the axis, as is apparent from FIG. 2. By "head" as used herein is meant the combination of: (i) a ball-striking body (i.e., the blade 26 in FIGS. 2–2B, although other types of ball-striking bodies fall within the scope of the invention, such as mallets and cavity back bodies, as will be explained), plus (ii) the hosel (if any) connecting the blade to the shaft, plus (iii) any lower portion of the shaft that is not aligned with the upper portion of the shaft when the putter is freely suspended. For example in the putter of FIGS. 2, 2A, 2B, the "center of gravity" of the head is the center of gravity of a structure comprised of the blade 26 plus the hosel 28, whereas in FIGS. 5A and 5B, the "center of gravity" of the head is considered to be the center of gravity of a structure comprised of the blade 26A, plus the hosel 28A, plus a lower portion 23A of the shaft which connects the hosel 28A to an upper or main portion of the shaft 22A. In the modified putter 20A' of FIG. 5C, the center of gravity of the head is the center of gravity of a structure comprised of the blade 26A, plus the hosel 28A' which connects the blade to the shaft.

The "center of gravity" can be defined with reference to axes X, Y and Z, i.e., a vertical axis Y and horizontal axes X, Z. The axes X, Z are oriented perpendicularly to the axis Y, and to one another. When the putter is freely suspended, the axis A of the shaft 22 will coincide with the vertical axis Y. If the axis Z is considered as oriented perpendicularly to the putting face (i.e., assuming that the putting face has no loft), and if the axes X, Y, Z intersect at the center of gravity, then the following three conditions will co-exist. Firstly, an imaginary plane containing axes Y and X and extending perpendicularly to axis Z will divide the head into front and rear portions. Secondly, an imaginary plane containing axes X and Z and extending perpendicularly to axis Y will divide the head into upper and lower portions. Thirdly, an imaginary plane containing axes Y and Z and extending perpendicularly to axis X will divide the head into heel and toe portions. The integrated sum of all mass-times-distance moments around any axis (X, Y or Z) equals zero. In other words, the putting head is omnibalanced.

Importantly, the upper surface 36 (see FIGS. 2–2B) extends perpendicularly to the shaft axis A. Accordingly, as shown in FIG. 2A, when the shaft 22 is freely suspended, the shaft axis A will correspond to the axis Y which passes through the center of gravity, and the upper surface 36 will be oriented horizontally (since the surface 36 is oriented perpendicularly to the shaft axis A). Thus, each of the front and rear edges 40, 42 of the top surface 36 (assuming a right-handed putter) will define a horizontal reference line which, when compared to the surface of a golf green, can aid in determining the slope of the green.

Figure 3:
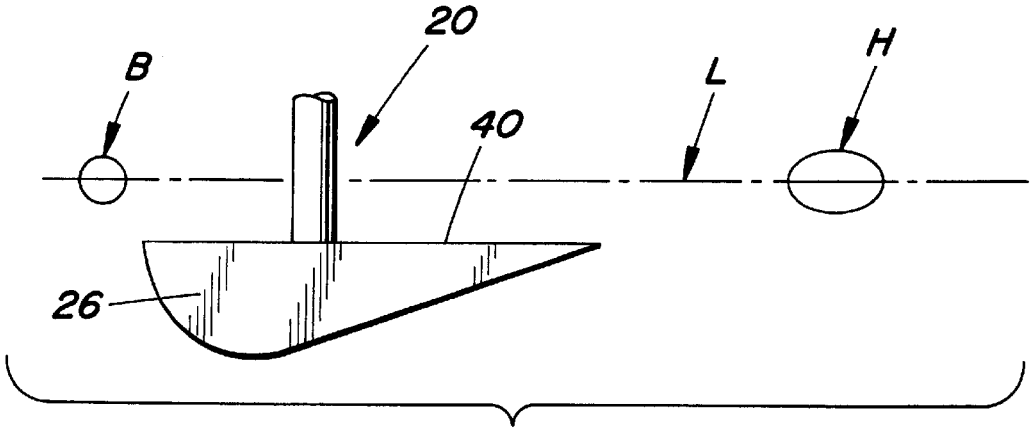
FIG. 3 is a schematic view depicting one way in which the putter of FIG. 2 could be used to aid in reading the slope of a putting green.

For example, the horizontal reference line can provide an indication of whether the hole is uphill ordownhill from the ball. In that regard, as shown in FIG. 3, which is seen through the eyes of a golfer, if the golfer faces substantially perpendicularly toward an imaginary line L extending through the ball B and the hole H, and suspends the putter in front of his/her face, the horizontal front edge 40 or rear edge 42 of the blade can be compared with the imaginary line L. If the horizontal edge and the line L correspond with one another, as shown in FIG. 3, then it is indicated that the ball and hole are at about the same elevation, i.e., the hole is neither uphill nor downhill from the ball. If the line L is inclined upwardly relative to the edge 40 in a direction toward the hole, then it is indicated that the hole is uphill from the ball. If the line L is inclined downwardly from the ball, however, then it is indicated that the hole is downhill from the ball.

Figure 4:
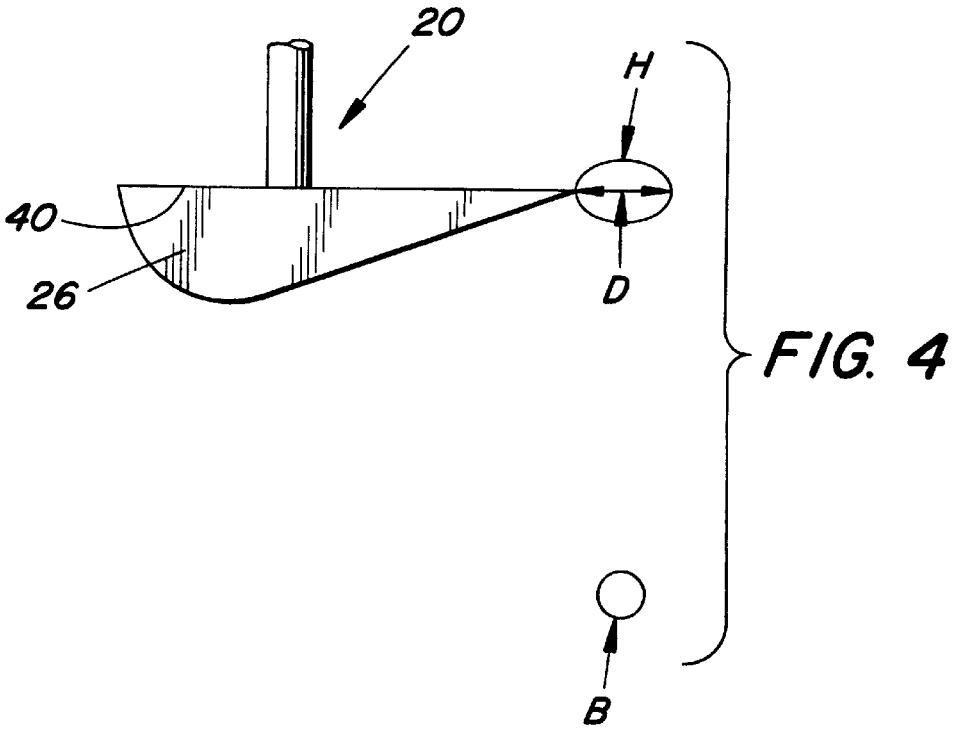
FIG. 4 is a schematic view depicting another way in which the putter of FIG. 2 could be used in aiding the reading of a slope of a putting green.

Furthermore, the golfer can stand behind the ball on a line extending through the ball and the hole and use the horizontal reference line as an aid in determining whether the green slopes to the right or left. For example, by positioning the reference edge 40 next to the hole H, as shown in FIG. 4, it can be seen whether a diameter D perpendicular to the putting line of the hole is aligned with the reference line, or is inclined relative thereto. If the diameter is inclined, then that fact can be used as an indication that the ground immediately surrounding the hole is inclined in a similar direction.

It will be appreciated that since the putter 20 hangs vertically, it can be used to perform a traditional plumb bob analysis if a golfer so chooses.

However, it will be appreciated that it is easier to visualize the slope of a green, i.e. the inclination of the green relative to horizontal, if the green is compared to a horizontal reference line rather than to a vertical reference line, so a main advantage of the green-reading feature of the present invention results from the provision of a truly horizontal reference line when the putter is freely suspended.

It will be understood that golfers will devise various ways of utilizing the horizontal and/or vertical reference lines to aid in reading the slopes of a green, both around the hole and between the ball and the hole.

It will be appreciated that the provision of a putting head whose center of gravity is intersected by the axis A of the shaft (as shown in FIGS. 1, 2, 5A–5C and 7) can be achieved by removing from, or adding weight to, appropriate locations of the putting head using materials of the same or different density as the blade.

Figure 5A:
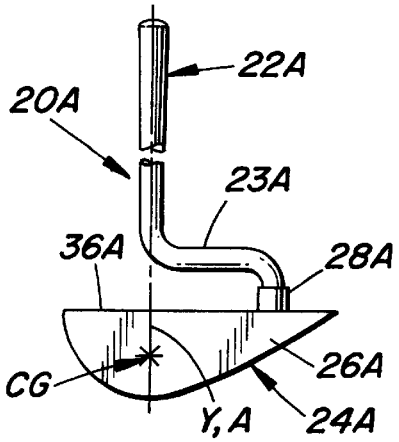
FIG. 5A is a front elevational view of a second embodiment of a putter according to the present invention, which is hanging in a freely suspended state.
Figure 5B:
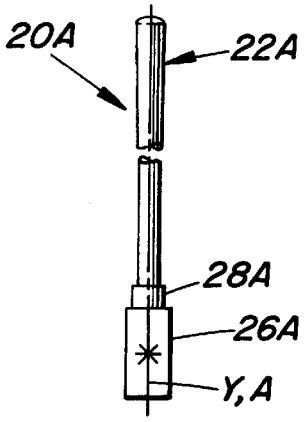
FIG. 5B is a side elevational view of the putter depicted in FIG. 5A.

Also, as shown in FIG. 5A, the hosel 28A of a putter 20A could be offset from the shaft axis A of the main portion of the shaft 22A, with the shaft axis A passing through the center of gravity of the head 24A that is comprised of: (i) the blade 26A, (ii) the hosel 28A, and (iii) a lower portion 23A of the shaft that interconnects the hosel with a main or upper portion of the shaft. In that case, if the interconnecting portion 23A which interconnects the shaft's main portion with the hosel, extends perpendicularly to shaft axis A, then that interconnecting portion 23A will define a horizontal reference line when the putter is suspended. In other words, in the embodiment according to FIGS. 5A and 5B, the horizontal reference line could be provided by the upper surface 36A of the blade, or by the interconnecting portion 23A of the shaft. In this case, the top edge of the ball-striking portion need not be perpendicular to the axis A.

Figure 5C:
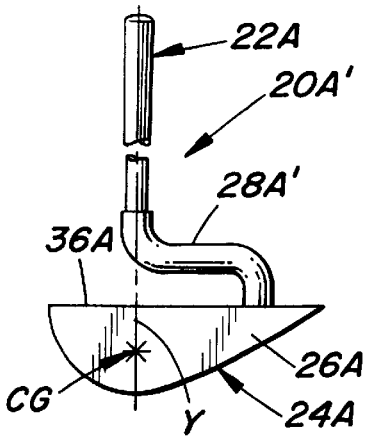
FIG. 5C is a view similar to FIG. 5A of a modified hosel.

In FIG. 5C a putter 20A' is depicted wherein the hosel 28A' forms the horizontal portion instead of a lower portion of the shaft.

Figure 6A:
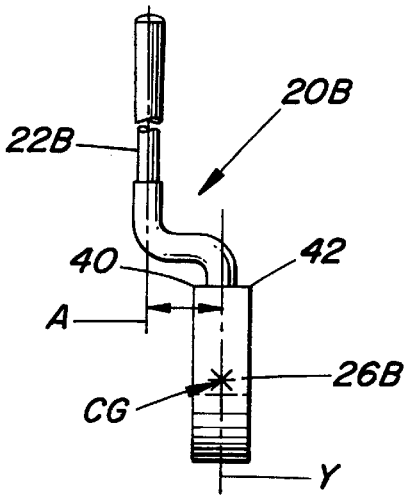
FIG. 6A is a side elevational view of a third embodiment of a putter according to the present invention, when in a putting position.
Figure 6B:
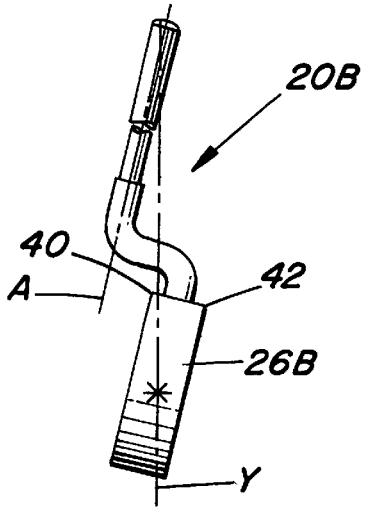
FIG. 6B is a side elevational view of the putter of FIG. 6A when hanging in a freely suspended state.
Figure 6C:
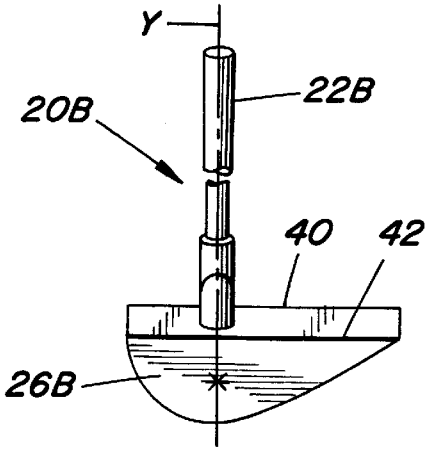
FIG. 6C is a front elevational view of FIG. 6B.

Another embodiment of a putter 20B is depicted in FIGS. 6A–6C. In that embodiment, the shaft axis A is offset (usually forwardly) from the front face of the blade 26B. That means that when the putter is suspended by the shaft 22B, the blade 26B will be slightly inclined (see FIGS. 6B, 6C). The front and rear edges 40, 42, however, will define horizontal reference lines when the putter is suspended, as can be seen in FIG. 6C.

The present invention can also be utilized in putters where the putting face is not exactly vertical when the putter is in a putting position. That is, the putting face of the putter could be inclined by a slight angle relative to vertical. Also, the center of gravity of the head is located to achieve an optimum putting stroke.

The invention has been thus far described with reference to a blade type of putter. However, it will be appreciated that it is also applicable to any kind of a putter, including mallet or cavity-back putters (i.e., putters having a shape formed rearward of the putting face to improve the "sweet spot" of the putter).

Figure 7:
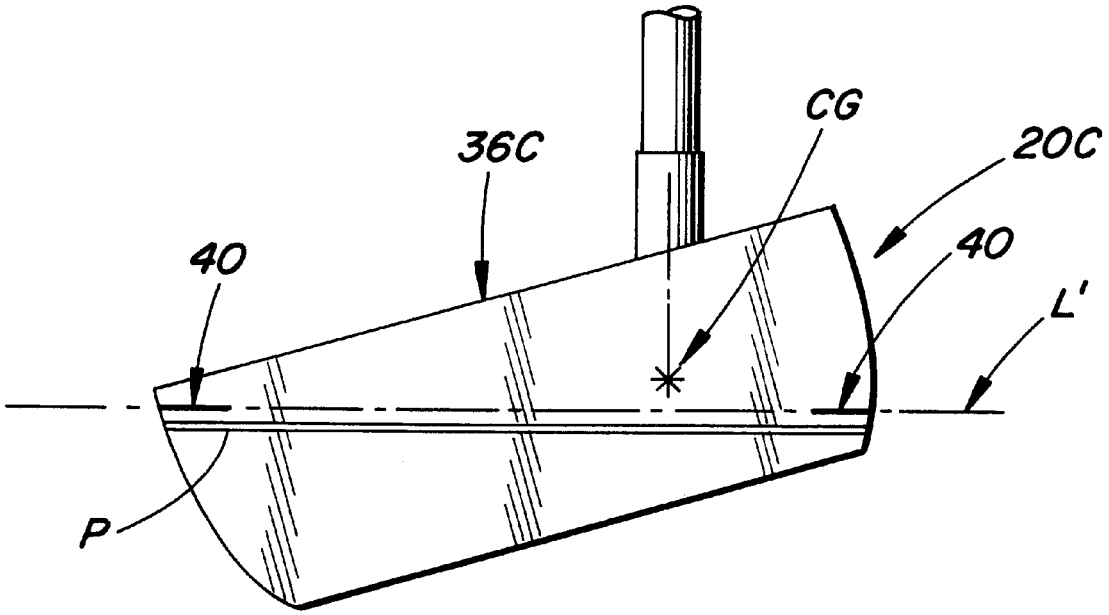
FIG. 7 is a front elevational view of a fourth embodiment of a putter according to the present invention while hanging in a freely suspended state.

In accordance with the present invention, the horizontal reference line need not be defined by the front or rear edge of the top surface of the putting head, or by a portion of the hosel or the shaft. That is, the horizontal reference line L' of a putter 20C could be defined by a pair of aligned indicator lines or notches 40 formed in the heel and toe, respectively, of the putting head, as shown in FIG. 7. In that case, a line defined by the notches would extend horizontally when the putter is suspended; the top surface 36C of the putting head need not be disposed horizontally when the putter is suspended, as shown in FIG. 7. Other ways of forming the indicator lines are possible, e.g., by creating visible machining lines during the manufacture of the putter, such as by polishing lines P, some of which being shown in FIG. 7.

It should be understood that the axis A of the shaft need not extend exactly through the center of gravity of the putting head to achieve the greenreading feature of the present invention. That is, if the shaft axis A does not extend through the center of gravity, the shaft will not hang perfectly vertically, as noted earlier, but rather will be inclined by some angle relative to vertical. In that event, the part of the putter that is intended to constitute the horizontal reference line would be inclined by the same angle relative to shaft axis to ensure that the reference line will extend horizontally when the shaft is freely suspended. Thus, the green reading feature of the present invention requires that the putter head provide a horizontal reference line whenever the putter is freely suspended.

On the other hand, there are certain advantages to having the shaft axis A pass through the center of gravity. For one thing, the shaft will extend exactly vertically when freely suspended, enabling the shaft to function as a vertical reference line, e.g. for the traditional plumb bob technique.

Furthermore, if the shaft axis A passes through the center of gravity, then it has been found that it is less likely that the putting head will twist about the shaft axis A as a result of an imbalance with the shaft during the backstroke, making it easier to keep the putting head on the intended putting line during the backstroke and the forward stroke. More specifically, due to the previously described omnibalance characteristic of the putter, all forces that might tend to rotate the shaft in a clockwise direction during the back swing are effectively counterbalanced by forces acting in a counterclockwise direction, and vice versa. (This advantage will result even if the putter does not provide a horizontal reference line when suspended, and thus is independent of the previously described green-reading feature).

It will also be appreciated that in cases where the shaft axis A of a suspended putter does not coincide with the vertical axis Y passing through the center of gravity, the angle formed between the axes A and Y will become progressively smaller the farther from the head that the shaft is gripped. It would be possible in such a case to provide the shaft with calibrated marks to indicate the actual angle of inclination the shaft is hanging, in the event that such information may be helpful to players in analyzing the slopes of the green.

In sum, the present invention provides a putter whose lower portion has a horizontal reference line when the putter is suspended by the shaft, and/or a putter whose shaft axis passes through a center of gravity of the putting head.

Although the present invention has been described in connection with preferred embodiments thereof, it will be appreciated by those skilled in the art that additions, deletions, modifications, and substitutions not specifically described may be made without departing from the spirit and scope of the invention as defined in the appended claims.

What is claimed is:

1. A golf putter comprising:

a shaft defining a longitudinal axis, and a putting head mounted at a lower end of the shaft, the putting head including a ball-striking body having a top edge;

the longitudinal axis of the shaft passing through a center of gravity of the putting head, and oriented perpendicular to the top edge;

the longitudinal axis of the shaft oriented vertically when the putter is freely suspended by the shaft;

the top edge extending horizontally when the putter is freely suspended by the shaft;

the top edge oriented non-horizontally when the putter is oriented in an address position;

the ball-striking body of the putting head being configured asymmetrically with respect to the longitudinal axis of the shaft.

2. The golf putter according to claimYwherein the ball-striking body of the putting head includes a sole having a heel end and a toe end, the toe end being situated closer to the axis than is the heel end.

3. The golf putter according to claim 1 wherein the top edge includes a heel end and a toe end, the ball-striking body being continuously curved from the toe end of the top edge to the toe end of the sole.

4. The golf putter according to claim 1 wherein the ball-striking body includes a sole, the sole and the top edge arranged in mutually diverging relationship in a direction toward a toe of the ball-striking body.

5. A method of reading a slope of a putting green utilizing a putter comprised of a shaft defining a longitudinal axis, and a putting head mounted at a lower end of the shaft, the putting head including a ball-striking body having a top edge, the longitudinal axis of the shaft passing through a center of gravity of the putting head, the method comprising the steps of:

A. freely suspending the shaft from any point therealong to cause the shaft to hang vertically and the top edge to be oriented horizontally; and B. visually comparing the horizontal top edge to the direction of a portion of the putting green.

6. The golf putter according to claim 1 wherein when the putter is freely suspended by the shaft:

the longitudinal axis of the shaft constitutes a first axis, a horizontal line extending through the center of gravity constitutes a second axis, a horizontal line extending through the center of gravity perpendicularly to a putting face of the putting head constitutes a third axis, and wherein the integrated sum of all mass-times-distance moments around any of the first, second, and third axes equals zero.

* * * * *